US007669618B1

(12) United States Patent
Halverson

(10) Patent No.: US 7,669,618 B1
(45) Date of Patent: Mar. 2, 2010

(54) WOOD PROCESSOR ATTACHMENT FOR SKID STEER LOADER

(76) Inventor: Glen Halverson, 3887 County Road 56, Pine River, MN (US) 56474

( * ) Notice: Subject to any disclaimer, the term of this patent is extended or adjusted under 35 U.S.C. 154(b) by 402 days.

(21) Appl. No.: 11/736,211

(22) Filed: Apr. 17, 2007

Related U.S. Application Data

(60) Provisional application No. 60/746,509, filed on May 5, 2006.

(51) Int. Cl.
*B27L 7/00* (2006.01)

(52) U.S. Cl. ..... 144/4.6; 144/193.1; 144/193.2; 144/195.1

(58) Field of Classification Search ..... 144/193.1, 144/193.2, 194, 195.1, 195.7, 195.8, 4.6, 144/2.1, 3.1
See application file for complete search history.

(56) References Cited

U.S. PATENT DOCUMENTS 3,862,651 A * 1/1975 Heikkinen ..... 144/4.6
4,173,237 A 11/1979 Heikkinen et al.
4,269,242 A 5/1981 Smith et al.
4,284,112 A 8/1981 Hoskin
4,286,638 A 9/1981 Connolly et al.
4,373,564 A * 2/1983 Heikkinen ..... 144/366
4,478,263 A 10/1984 Johnston
4,573,507 A 3/1986 Harboe
5,894,873 A 4/1999 Weeks
6,390,160 B2 * 5/2002 Pitkaniemi ..... 144/4.6
6,520,226 B1 2/2003 Smith
6,609,547 B1 8/2003 Machkovech

* cited by examiner

*Primary Examiner*—Shelley Self

(57) ABSTRACT

A wood processor attachment for skid steer loader for efficiently cutting and splitting logs. The wood processor attachment for skid steer loader generally includes a pivotally mounted support structure including a receiving end, a working end opposite the receiving end and a loading apparatus. A conveying member, a cutting unit, a ram and a wedge are attached to the support structure. The loading apparatus extends from the receiving end, wherein the loading apparatus transfers a log to the conveying member. The conveying member travels between the receiving end and the working end, wherein the cutting unit, the ram and the wedge are adjacent the working end to selectively cut and split the log. The support structure may be pivotally mounted upon various objects, such as but not limited to a skid steer loader or a tractor.

20 Claims, 7 Drawing Sheets

WOOD PROCESSOR ATTACHMENT FOR SKID STEER LOADER

CROSS REFERENCE TO RELATED APPLICATIONS

I hereby claim benefit under Title 35, United States Code, Section 119(e) of U.S. provisional patent application Ser. No. 60/746,509 filed May 5, 2006. The 60/746,509 application is currently pending. The 60/746,509 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to wood processors and more specifically it relates to a wood processor attachment for skid steer loader for efficiently cutting and splitting logs.

2. Description of the Related Art

Any discussion of the prior art throughout the specification should in no way be considered as an admission that such prior art is widely known or forms part of common general knowledge in the field.

Wood processors have been in use for years. Typically, wood processors are comprised of various configurations. Wood processors may be manufactured to cut logs, split logs or both. Wood processors can be very useful, in that it would generally take an individual a long time and require a lot of manual effort to cut and split the amount of logs generally processed by the wood processor.

There have been known to be wood processors that both cut and split logs. However, many of these prior wood processors are positioned upon a trailer which may decrease maneuverability. This can especially be a problem in areas such as in the woods or at construction sites because of the many nearby obstacles (i.e. trees, materials, etc.) and the need to maneuver around such obstacles.

Other wood processors that both cut and split logs may be very large in size, which generally makes the wood processor inefficient and/or costly. Because of the general lack of efficiency and practicality in the prior art there is the need for a new and improved wood processor attachment for skid steer loader for efficiently cutting and splitting logs.

BRIEF SUMMARY OF THE INVENTION

The general purpose of the present invention is to provide a wood processor attachment for skid steer loader that has many of the advantages of the wood processors mentioned heretofore. The invention generally relates to a wood processor which includes a pivotally mounted support structure including a receiving end, a working end opposite the receiving end and a loading apparatus. A conveying member, a cutting unit, a ram and a wedge are attached to the support structure. The loading apparatus extends from the receiving end. The conveying member travels between the receiving end and the working end, wherein the cutting unit, the ram and the wedge are adjacent the working end. The support structure may be pivotally mounted upon various objects, such as but not limited to a skid steer loader or a tractor.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a wood processor attachment for skid steer loader for efficiently cutting and splitting logs.

Another object is to provide a wood processor attachment for skid steer loader that is easy to utilize.

An additional object is to provide a wood processor attachment for skid steer loader that is highly maneuverable.

A further object is to provide a wood processor attachment for skid steer loader that may cut logs to various lengths.

Another object is to provide a wood processor attachment for skid steer loader that may accommodate a wide variety of log lengths and widths.

Another object is to provide a wood processor attachment for skid steer loader that may attach upon various types of loaders or vehicles, such as but not limited to a tractor.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
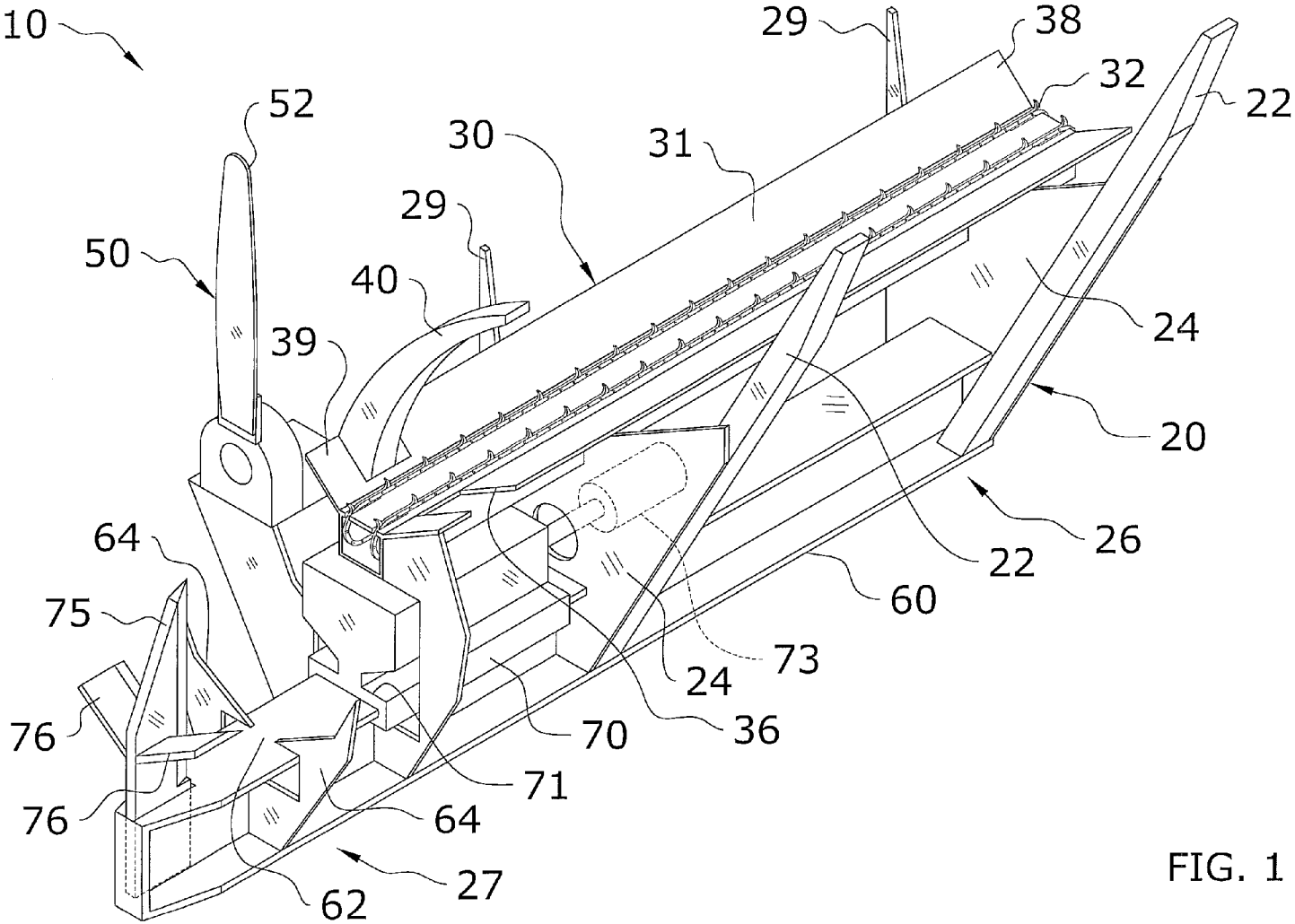
FIG. 1 is an upper perspective view of the present invention.

Turning now descriptively to the drawings, in which similar reference characters denote similar elements throughout the several views, FIGS. 1 through 7 illustrate a wood processor attachment for skid steer loader 10, which comprises a pivotally mounted support structure 20 including a receiving end 26, a working end 27 opposite the receiving end 26 and a loading apparatus 22. A conveying member 32, a cutting unit 50, a ram 70 and a wedge 75 are attached to the support structure 20. The loading apparatus 22 extends from the receiving end 26, wherein the loading apparatus 22 transfers a log 13 to the conveying member 32. The conveying member 32 travels between the receiving end 26 and the working end 27, wherein the cutting unit 50, the ram 70 and the wedge 75 are adjacent the working end 27 to selectively cut and split the log 13. The support structure 20 may be pivotally mounted upon various objects, such as but not limited to a skid steer loader 16 or a tractor.

In the following description the skid steer loader 16 is the vehicle shown with the present invention in FIGS. 2 through 7; however it is appreciated that any suitable vehicle may be utilized with the present invention, such as but not limited to various types of loaders 16 including a tractor, a CATERPILLAR, a front end loader 16 or a rear end loader 16. It is further appreciated that in certain circumstances the present invention may be utilized without a vehicle.

The present invention is also preferably powered via hydraulics and electronics of the loaders 16 utilized with the present invention. It is appreciated however that the present invention may include an independent power source. Various hydraulic hoses and electrical wires are also preferably present between the present invention and the loader 16 to provide power to the present invention.

A manner in which to attach the support structure 20 to the loader arms of the loader 16 is preferably comprised of a quick-attach method of attachment common in the art of loaders 16. The support structure 20 includes an attachment structure 29 to attach the present invention to the loader 16. It is appreciated that various methods of attachment of the support structure 20 to the loader 16 may be utilized with the present invention rather than the described methods.

B. Support Structure

Figure 2:
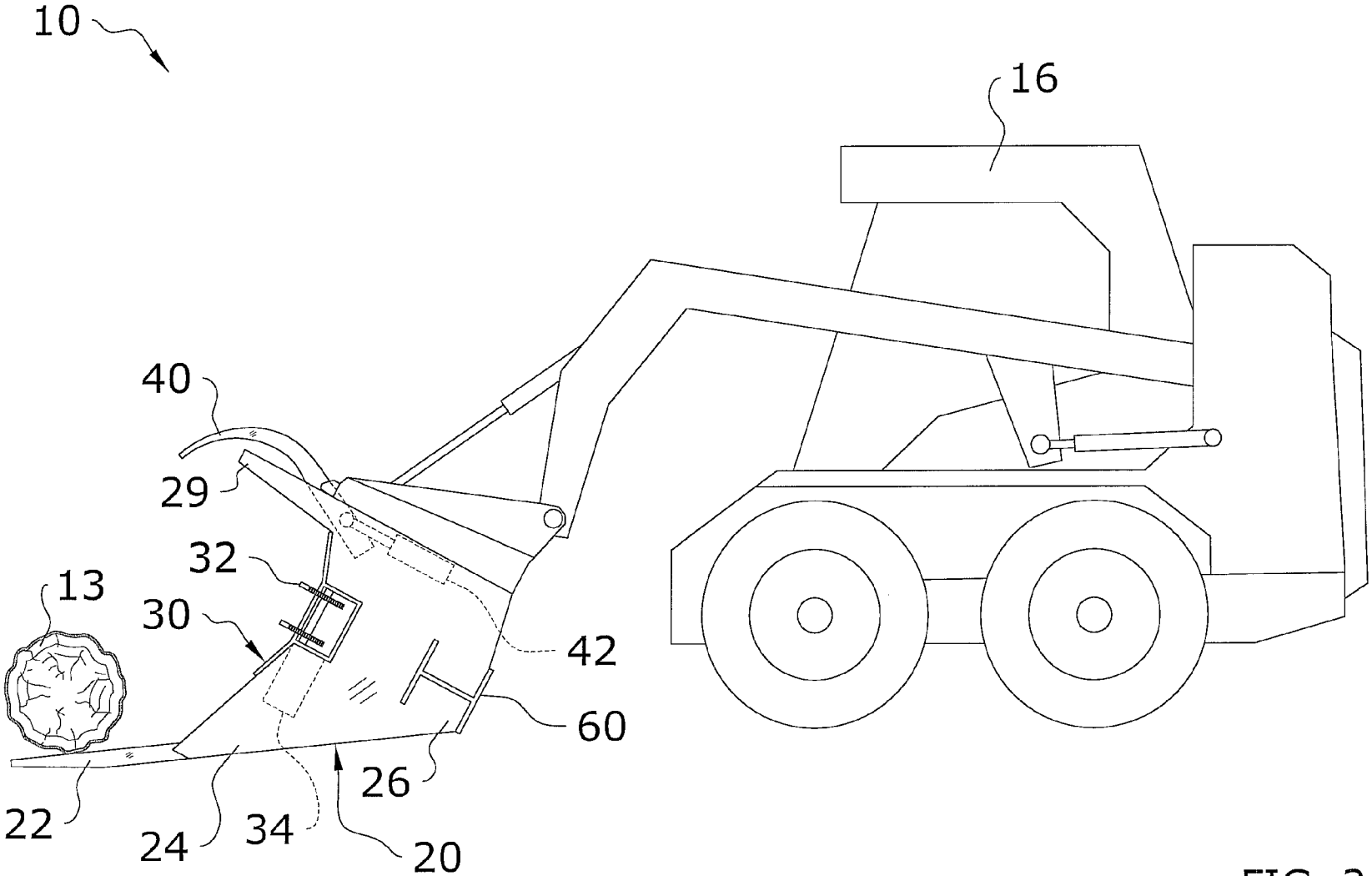
FIG. 2 is a side view of the present invention attached to a skid steer loader, wherein the present invention is pivoted downwards and a log is positioned upon the loading apparatus.
Figure 3:
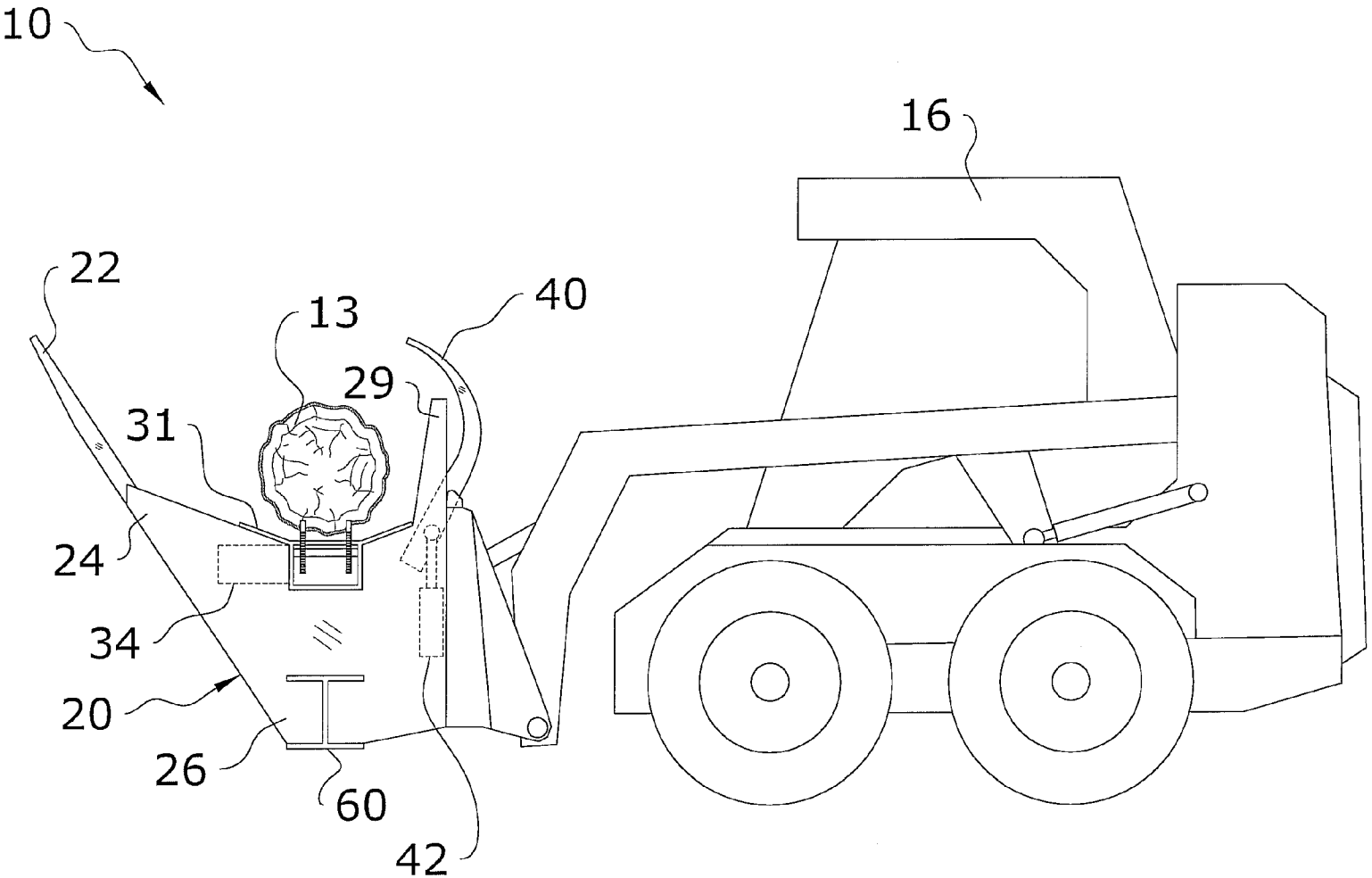
FIG. 3 is a side view of the present invention attached to a skid steer loader, wherein the present invention is pivoted upwards and a log is positioned upon the conveying member.
Figure 5:
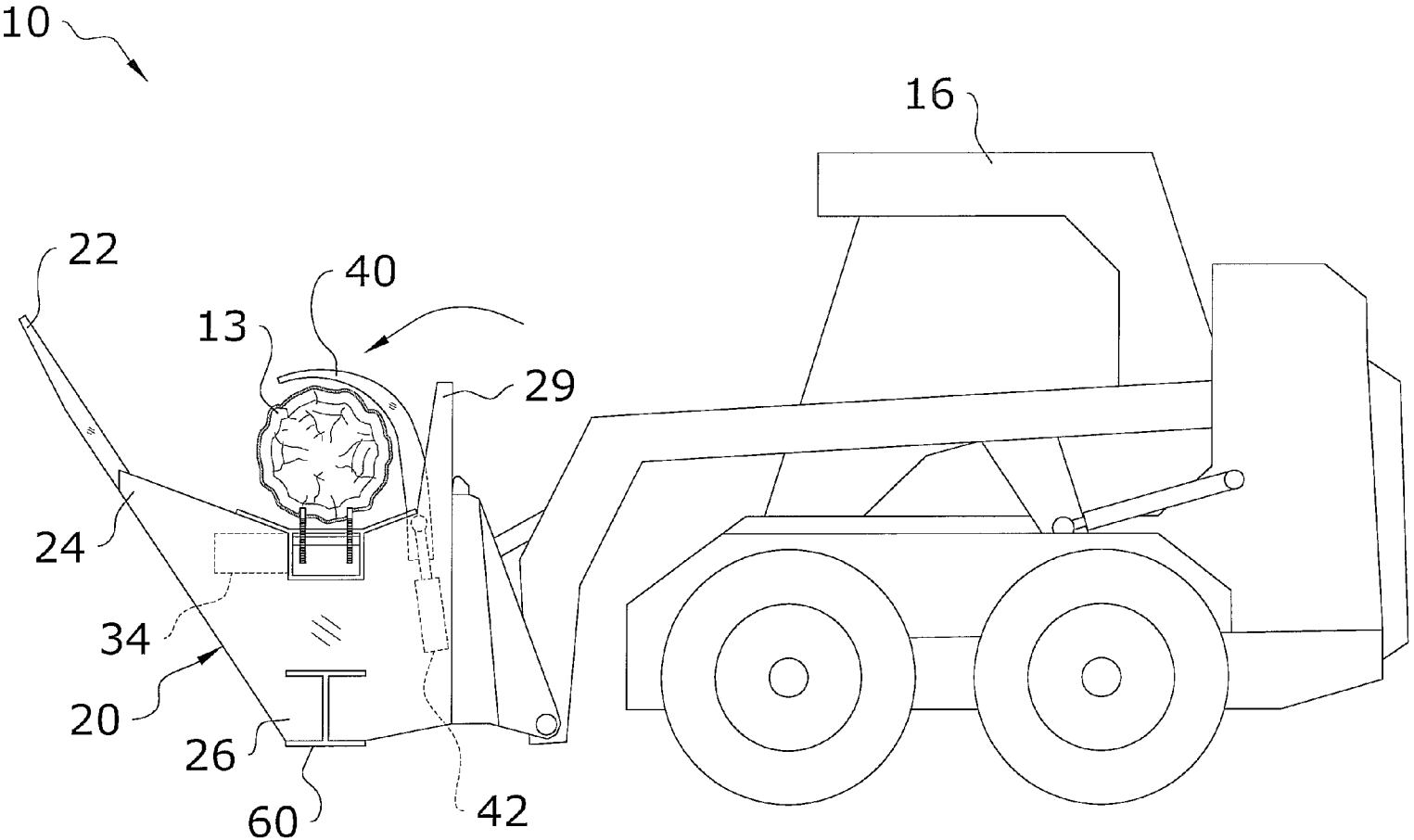
FIG. 5 is a side view of the present invention attached to a skid steer loader, wherein the clamp is pivoted downwards upon the log.

The support structure 20 is preferably attached to the loader 16 via the attachment structure 29 as illustrated in FIGS. 2, 3 and 5. The support structure 20 is further preferably able to be pivoted by the loader 16 as illustrated in FIGS. 2 and 3. The support structure 20 is comprised of a rigid structure to handle logs 13 and other materials of excessive weight. The support structure 20 is also preferably comprised of a substantially strong and durable material, such as but not limited to metal and/or steel.

The support structure 20 is also preferably comprised of a substantially elongated structure, wherein the longitudinal axis of the support structure 20 intersects the longitudinal axis of the loader 16 to achieve a more compact overall structure and allow for greater maneuverability of the present invention and the loader 16. The support structure 20 may be comprised of various shaped configurations. In the preferred embodiment of the present invention, the support structure 20 is comprised of a shape to resemble a bucket common in the art of loader 16 attachments as illustrated in FIGS. 2, 3 and 5.

The support structure 20 includes a working end 27 and a receiving end 26 opposite the working end 27 as illustrated in FIGS. 1 through 7. The receiving end 26 and the working end 27 are further preferably upon opposing longitudinal ends of the support structure 20. The support structure 20 preferably attaches to the loader 16 adjacent the receiving end 26, wherein the attachment mechanism 29 extends from the receiving end 26.

The support structure 20 preferably receives the logs 13 upon the receiving end 26 and cuts and splits the logs 13 at the working end 27 of the support structure 20 as illustrated in FIGS. 2 through 7. Both the receiving end 26 and the working end 27 are preferably aligned along the longitudinal axis of the support structure 20, wherein the log 13 travels in a straight and fluid motion from the receiving end 26 to and through the working end 27.

The support structure 20 also includes a loading apparatus 22 extending from the receiving end 26 opposite the attachment mechanism 29 as illustrated in FIGS. 1 through 7. The loading apparatus 22 preferably extends transverse to the longitudinal axis of the support structure 20. The loading apparatus 22 is also preferably comprised of a substantially rigid structure. The loading apparatus 22 serves to transfer the logs 13 from the ground or other place (i.e. log 13 piles, other machinery, etc.) to the conveyor unit 30.

When the support structure 20 is pivoted in a downward manner, the loading apparatus 22 is preferably level with the ground surface, wherein the operator of the loader 16 may drive forward to scoop up the log 13 or a log 13 may be positioned upon the loading apparatus 22 as illustrated in FIG. 2. When the support structure 20 is subsequently pivoted in an upward manner, the log 13 freely rolls downward along the loading apparatus 22 and onto the conveyor unit 30 to be processed.

In the preferred embodiment of the present invention, the loading apparatus 22 is preferably comprised of a pair of forks as illustrated in FIG. 1. It is appreciated however that the loading apparatus 22 may be comprised of various configurations rather than the preferred embodiment. Outer ends of the loading apparatus 22 are also preferably distally spaced along the receiving end 26 of the support structure 20 to efficiently support elongated logs 13.

The support structure 20 may also include a pair of support plates 24 to support the loading apparatus 22 and conveyor unit 30 as illustrated in FIGS. 1 through 7. The support plates 24 may also serve to prevent debris from easily entering within the support structure 20.

C. Conveyor Unit

The conveyor unit 30 extends from the receiving end 26 to the working end 27 of the support structure 20 and further transfers the logs 13 from the receiving end 26 to the working end 27 as illustrated in FIGS. 2 through 7. A longitudinal axis of the conveyor unit 30 is also parallel with a longitudinal axis of the support structure 20. The conveyor unit 30 is also preferably comprised of a substantially strong and durable material, such as but not limited to metal and/or steel.

The first end 38 of the conveyor unit 30 is adjacent the receiving end 26 of the support structure 20 and a second end 39 of the conveyor unit 30 is adjacent the working end 27 of the support structure 20. The conveyor unit 30 includes a trough 31 and a conveying member 32 circumscribing a longitudinal length of the trough 31 and extending from the first end 38 to the second end 39 as illustrated in FIGS. 2 through 7. The trough 31 may be comprised of various configurations all which substantially prevent the log 13 from rolling off of the conveyor unit 30 during transfer from the receiving end 26 to the working end 27.

The trough 31 also preferably includes a pair of cutaway portions 36 extending within the trough 31 adjacent the second end 39 as illustrated in FIG. 1. The cutaway portions 36 allow room for the clamp 40 to pivot about the conveyor unit 30 without engaging and damaging the trough 31.

In the preferred embodiment of the present invention, the conveying member 32 is preferably comprised of a toothed chain as illustrated in FIG. 1. It is appreciated however that the conveying member 32 may be comprised of various configurations, such as but not limited to a belt. The conveying member 32 travels along a longitudinal axis of the trough 31.

The conveying member 32 is preferably powered via a motor 34. The motor 34 is preferably electronically turned on inside the cab of the loader 16. However, various mechanisms, including the loader 16, may be utilized to provide power to the conveying member 32 and various methods may be utilized to turn the power on/off.

D. Clamp

Figure 6:
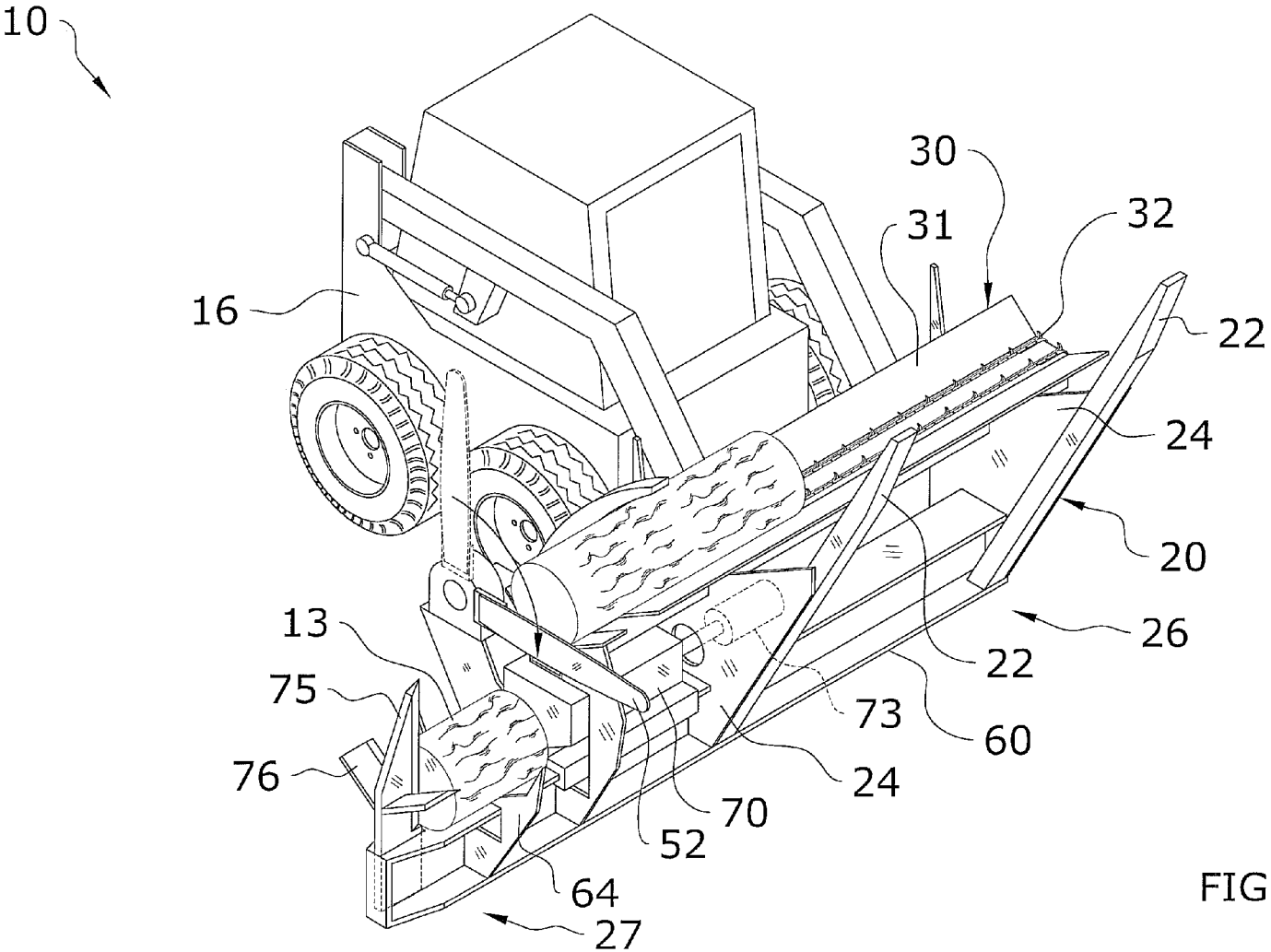
FIG. 6 is a side view of the present invention attached to a skid steer loader, wherein the clamp is pivoted downwards upon the log and the cutting unit is activated and pivoted downwards thus cutting a portion of the log.

The clamp 40 of the present invention is preferably pivotally attached adjacent the working end 27 of the support structure 20 and the second end 39 of the conveyor unit 30. The clamp 40 also selectively pivots over the conveyor unit 30 to secure the log 13 upon the conveyor unit 30 during the cutting of the log 13 via the cutting unit 50 as illustrated in FIGS. 5 and 6. The clamp 40 further preferably extends within the cutaway portions 36 of the conveyor unit 30.

The clamp 40 is selectively pivoted via a first actuator 42 extending between the clamp 40 and the support structure 20 as illustrated in FIGS. 2, 3 and 5. The first actuator 42 may be comprised of various configurations, such as but not limited to a hydraulic cylinder. In the preferred embodiment of the present invention, the first actuator 42 is powered via the hydraulics of the loader 16 and controlled via controls within the cab of the loader 16. It is appreciated however that the first actuator 42 may be powered utilizing various mechanisms, such as but not limited to an independent power source.

The clamp 40 may be comprised of various configurations. In the preferred embodiment of the present invention, the clamp 40 is comprised of an arc-shaped configuration as illustrated in FIGS. 2, 3 and 5. The clamp 40 is also preferably comprised of a substantially strong and durable material, such as but not limited to metal and/or steel.

E. Cutting Unit

Figure 7:
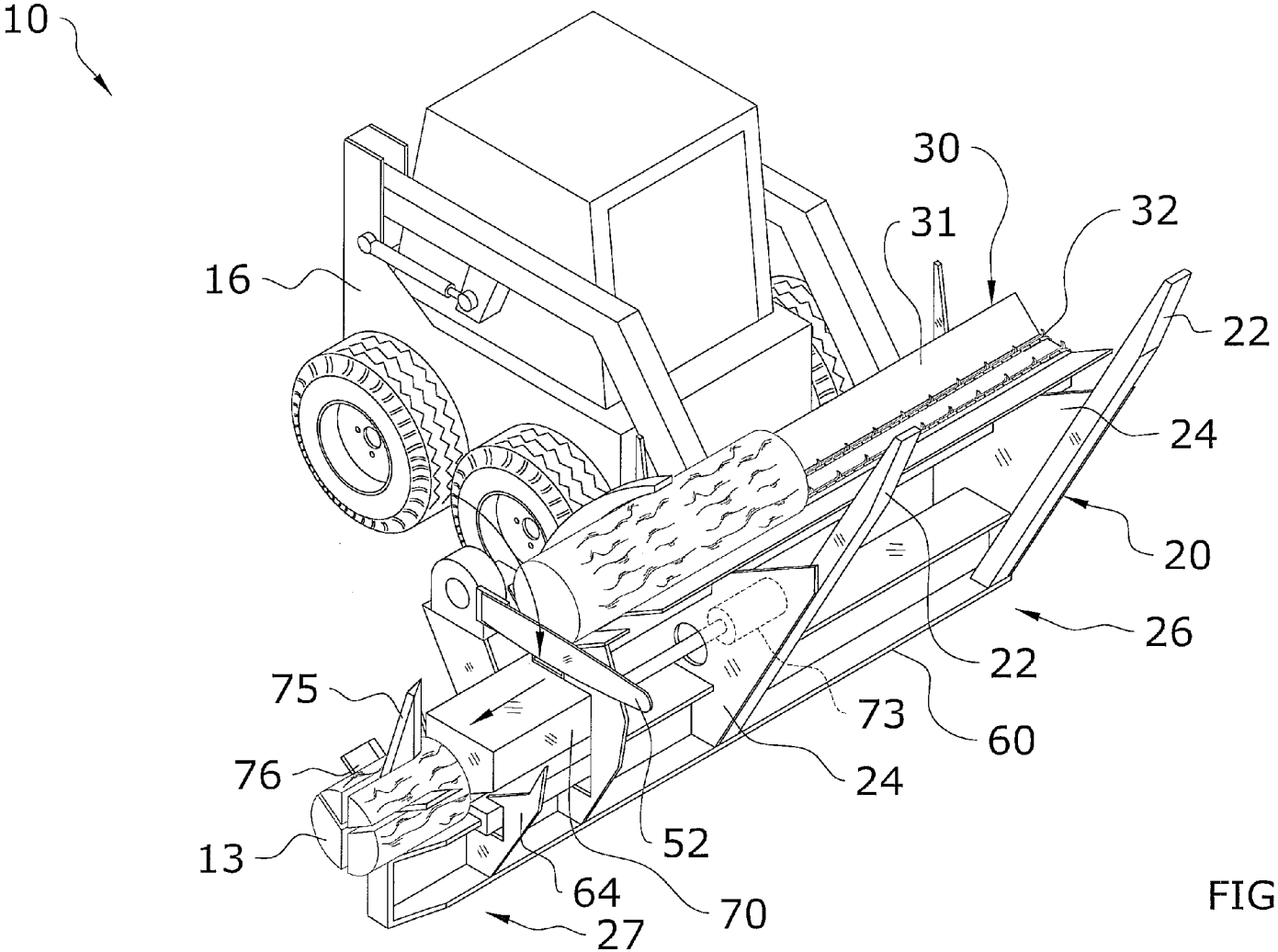
FIG. 7 is a side view of the present invention attached to a skid steer loader, wherein the ram is forcing the cut portion of the log past the wedge thus splitting the cut portion of the log.

The cutting unit 50 of the present invention is preferably pivotally attached adjacent the working end 27 of the support structure 20 and the second end 39 of the conveyor unit 30. The cutting unit 50 also selectively pivots over and directly past the second end 39 of the conveyor unit 30 to as illustrated in FIGS. 6 and 7.

The cutting unit 50 is selectively pivoted via the hydraulics of the loader 16 and or electronics of the loader 16, wherein the cutting unit 50 is preferably controlled via controls within the cab of the loader 16. It is appreciated however that the cutting unit 50 may be powered utilizing various mechanisms, such as but not limited to an independent power source.

The cutting unit 50 may be comprised of various configurations. In the preferred embodiment of the present invention, the cutting unit 50 is comprised of a chain saw configuration as illustrated in FIG. 1. The blade 52 of the cutting unit 50 rotates about the cutting unit 50 in a similar manner as a chainsaw blade 52. The speed and direction of the blade 52 is also preferably controlled via controls within the cab of the loader 16. The cutting unit 50 also preferably includes a motor to selectively operate the cutting unit 50.

F. Lower Support

The lower support 60 preferably extends an entire longitudinal length of the present invention as illustrated in FIGS. 1 through 7. The lower support 60 is preferably comprised of various materials, such as but not limited to metal or steel. The lower support 60 and the support structure 20 are preferably comprised of separate structures; however it is appreciated that the lower support 60 and the support structure 20 may be comprised of an integrally formed structure. The longitudinal axis of the lower support 60 is also preferably aligned and parallel with the longitudinal axis of the conveyor unit 30.

In the preferred embodiment of the present invention, the lower support 60 is comprised of an elongated I-beam configuration; however it is appreciated that the lower support 60 may be comprised of various configurations rather than the preferred embodiment.

Figure 4:
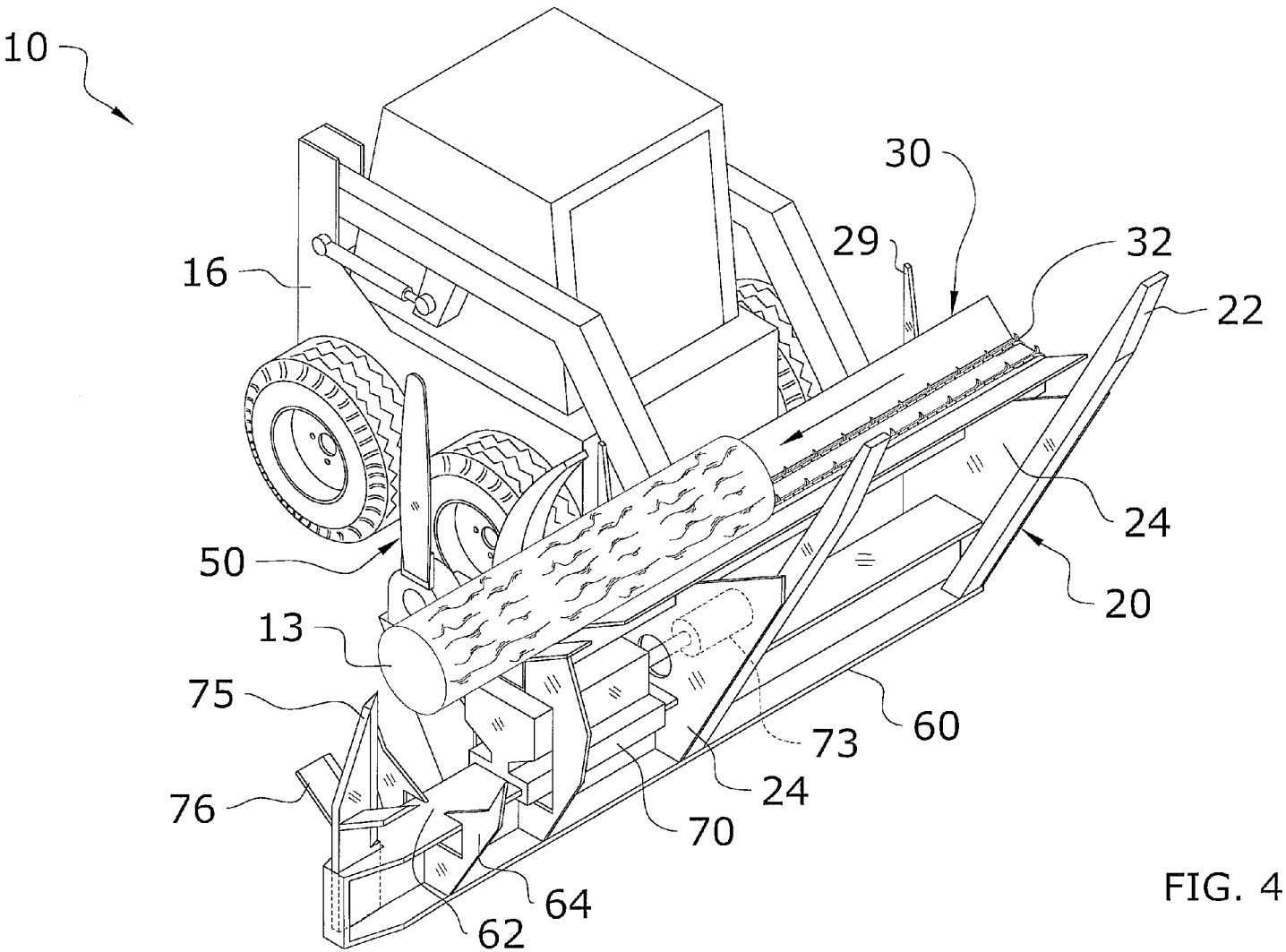
FIG. 4 is an upper perspective view of the present invention, wherein the log is traveling from the receiving end to the working end via the conveying member.

The lower support 60 includes a catch portion 62 adjacent the working end 27 of the support structure 20. The catch portion 62 is also positioned directly past a forward direction of travel of the conveyor unit 30. The catch portion 62 of the lower support 60 subsequently catches the cut portion of the log 13 as illustrated in FIGS. 4, 6 and 7. The catch portion 62 also preferably includes a pair of guide members 64 extending from opposing sides of the catch portion 62 to ensure that the cut portion of the log 13 is stabilized upon the catch portion 62 of the lower support 60.

The catch portion 62 may be comprised of various configurations, such as but not limited to curved or planar. In the preferred embodiment of the present invention, the catch portion 62 is comprised of a planar configuration to allow for easy movement of the ram 70 back and forth along the catch portion 62. The catch portion 62 may also be comprised of various lengths, wherein the length of the catch portion 62 is preferably long enough to efficiently support any length of the cut portion of the log 13 that may be desired.

It is also appreciated that for substantially elongated catch portions 62, there may be several pairs of guide members 64 to provide efficient stabilization for the cut portion of the logs 13. The catch portion 62 also preferably includes an opening near an outer end of the catch portion 62 opposite the ram 70 to selectively receive the wedge 75.

G. Ram and Wedge

The ram 70 is positioned upon the lower support 60 and also below the conveyor unit 30 as illustrated in FIG. 1. The ram 70 is further slidably attached upon the lower support 60, wherein the ram 70 selectively slides back and forth along the catch portion 62 of the lower support 60 via a second actuator 73. The second actuator 73 may be comprised of various configurations, such as but not limited to a hydraulic cylinder. In the preferred embodiment of the present invention, the second actuator 73 is powered via the hydraulics of the loader 16 and controlled via controls within the cab of the loader 16. It is appreciated however that the second actuator 73 may be powered utilizing various mechanisms, such as but not limited to an independent power source.

The ram 70 is comprised of a strong and durable material, such as but not limited to metal or steel. When sliding along the catch portion 62, the ram 70 preferably does not engage the wedge 75 to prevent dulling or damaging the wedge 75. The ram 70 also preferably includes a pair of recessed portions 71 extending within and along opposing longitudinal sides of the ram 70. The recessed portions 71 allow the ram 70 to slide past the guide members 64 without engaging the guide members 64 as illustrated in FIGS. 6 and 7.

The direction of travel of the ram 70 is also preferably similar to the direction of travel of the conveyor unit 30 as illustrated in FIGS. 4 and 7. As the ram 70 engages and pushes the cut portion of the log 13, the cut portion subsequently engages the wedge 75. The wedge 75 is removably attached within the catch portion 62. The wedge 75 is preferably comprised of a hardened metal or steel to prevent the wedge 75 from dulling upon frequent splitting of logs 13. If the wedge 75 does become dull, the wedge 75 may be removed from the lower support 60 and sharpened. It is also appreciated that the height of the wedge 75 may be adjusted to accommodate various size logs 13 and/or the height of the extending portions 76.

The wedge 75 preferably includes a sharpened edge facing the ram 70 and cut portion of the log 13. The wedge 75 also preferably includes a pair of extending portions 76 extending from opposing sides of the wedge 75 to further split the log 13 into multiple sections as illustrated in FIG. 7. The extending portions 76 are preferably comprised of a similar material as the wedge 75 and also include a sharpened edge facing the ram 70 and the cut portion of the log 13.

H. In Use

In use, the present invention is first attached to the loader 16 and all hydraulic hoses and electrical wires are subsequently attached. It is appreciated that the present invention may include a coupler to easily attach the electrical wires of the present invention to the electrical wires of the loader 16. The present invention may now be utilized.

The present invention is first pivoted downwards so that the loading apparatus 22 is parallel and substantially level with the ground surface as illustrated in FIG. 2. The loading apparatus 22 is also ensured to be substantially aligned with the log 13 that is desired to be processed. The loader 16 is now driven forward until the log 13 is positioned upon the loading apparatus 22. The present invention may now be pivoted upwards, wherein the log 13 subsequently rolls down within the trough 31 and upon the conveying member 32 of the conveyor unit 30 as illustrated in FIG. 3.

The operator of the loader 16 now starts the motor 34 and subsequently the conveying member 32 via controls of the loader 16. The log 13 thus is moved from the receiving end 26 of the support structure 20 to the working end 27 of the support structure 20 as illustrated in FIG. 4. When a desired length of the log 13 that is desired to be cut extends past the cutting unit 50 the operator stops the conveying member 32. It is appreciated that the conveying member 32 may also be ran in a reverse direction if the operator needs to adjust the amount of the log 13 extending past the cutting unit 50.

The clamp 40 is now activated via controls in the loader 16, wherein the clamp 40 secures the log 13 in place upon the conveyor unit 30 as illustrated in FIG. 5. The cutting unit 50 is subsequently started and pivoted over and through the log 13, thus cutting the portion of the log 13 extending past the cutting unit 50 off of the initial log 13 as illustrated in FIG. 6. The cut portion of the log 13 subsequently falls upon the catch portion 62 of the lower support 60 and is stabilized by the guide members 64. It is appreciated that the operation of the cutting unit 50 and the clamp 40 may be achieved utilizing multiple controls or a single control. In the preferred embodiment of the present invention, the operator holds down a single control, wherein holding down the control activates the clamp 40 and subsequently activates the cutting unit 50.

The operator may now disengage the control(s) for the cutting unit 50 and the clamp 40, thus allowing the cutting unit 50 and clamp 40 to return to the initial positions prior to cutting. The operator now engages the control to activate the second actuator 73 and thus ram 70. The ram 70 subsequently slides toward the wedge 75, thus sandwiching the cut portion of the log 13 between the wedge 75 and the ram 70. The cut portion of the log 13 is then forced past the wedge 75 and split via the wedge 75 as illustrated in FIG. 7. The ram 70 is then moved back to an initial position via disengaging the control for the ram 70.

Further portions of the log 13 may be cut and split by simply repeating the processes of the conveyor unit 30, clamp 40, cutting unit 50 and ram 70. It is appreciated that the above functions of the controls may be modified to accommodate various types of loaders 16 or vehicles that the present invention is attached to, wherein various types of controls may be utilized to selectively operate the present invention.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A wood processor attachment for skid steer loader, comprising:

a skid steer loader vehicle;

a support structure rigidly mounted to said skid steer loader vehicle, wherein said support structure is adapted to be pivoted by said skid steer loader vehicle;

wherein said support structure includes a receiving end, a working end and a loading apparatus, wherein said receiving end is opposite said working end and wherein said loading apparatus extends from said receiving end;

wherein said loading apparatus is rigidly mounted to said support structure to pivot with said support structure about said skid steer loader vehicle via said skid steer loader vehicle;

a conveyor unit including a conveying member, wherein said conveyor unit is attached to said support structure and wherein said conveying member travels between said receiving end and said working end; and a cutting unit attached to said support structure, wherein said cutting unit is adjacent said working end.

2. The wood processor attachment for skid steer loader of claim 1, wherein said conveyor unit include a trough, wherein said conveying member travels along said trough.

3. The wood processor attachment for skid steer loader of claim 1, including a clamp pivotally attached to said support structure, wherein said clamp selectively extends over said conveying member.

4. The wood processor attachment for skid steer loader of claim 1, wherein said loading apparatus extends substantially transverse from said conveying member.

5. The wood processor attachment for skid steer loader of claim 1, wherein said loading apparatus is comprised of a pair of forks.

6. The wood processor attachment for skid steer loader of claim 5, wherein said pair of forks extend transversely from said conveying member.

7. The wood processor attachment for skid steer loader of claim 1, wherein said cutter unit is comprised of a chain saw configuration.

8. The wood processor attachment for skid steer loader of claim 1, wherein said cutter unit is pivotally attached to said support structure.

9. The wood processor attachment for skid steer loader of claim 1, including:

a lower support extending from said support structure;

a ram slidably attached upon said lower support, wherein said ram is adjacent said working end; and a wedge attached upon said lower support, wherein said wedge is adjacent said working end.

10. The wood processor attachment for skid steer loader of claim 9, wherein said wedge is aligned with said conveying member.

11. The wood processor attachment for skid steer loader of claim 9, wherein a first direction of travel of said conveying member is substantially similar to a second direction of travel of said ram.

12. The wood processor attachment for skid steer loader of claim 11, wherein said ram is positioned directly below said conveying member.

13. A wood processor attachment for skid steer loader, comprising:

a skid steer loader vehicle;

a support structure rigidly mounted to said skid steer loader vehicle, wherein said support structure is adapted to be pivoted by said skid steer loader vehicle;

wherein said support structure includes a receiving end, a working end and a loading apparatus, wherein said receiving end is opposite said working end and wherein said loading apparatus extends from said receiving end;

wherein said loading apparatus is rigidly mounted to said support structure to pivot with said support structure about said skid steer loader vehicle via said skid steer loader vehicle;

a conveyor unit including a conveying member, wherein said conveyor unit is attached to said support structure and wherein said conveying member travels between said receiving end and said working end;

a cutting unit attached to said support structure, wherein said cutting unit is adjacent said working end;

a lower support extending from said support structure;

a ram slidably attached upon said lower support, wherein said ram is adjacent said working end; and a wedge attached to said lower support, wherein said wedge is adjacent said working end.

14. The wood processor attachment for skid steer loader of claim 13, wherein said loading apparatus is comprised of a pair of forks.

15. The wood processor attachment for skid steer loader of claim 13, wherein a first direction of travel of said conveying member is substantially similar to a second direction of travel of said ram.

16. A wood processor attachment for skid steer loader, comprising:

a support structure including a receiving end, a working end and a loading apparatus, wherein said receiving end is opposite said working end and wherein said loading apparatus extends from said receiving end;

wherein said support structure attaches to a loader and wherein said support structure pivots about said vehicle;

a conveyor unit including a conveying member, wherein said conveyor unit is attached to said support structure and wherein said conveying member travels between said receiving end and said working end;

a cutting unit attached to said support structure, wherein said cutting unit is adjacent said working end;

wherein said conveyor unit include a trough, wherein said conveying member travels along said trough;

a clamp pivotally attached to said support structure, wherein said clamp selectively extends over said conveying member;

wherein said loading apparatus extends substantially transverse from said conveying member;

wherein said loading apparatus is comprised of a pair of forks;

wherein said cutter unit is comprised of a chain saw configuration and wherein said cutter unit is pivotally attached to said support structure;

a lower support extending from said support structure;

a ram slidably attached upon said lower support, wherein said ram is adjacent said working end and wherein said ram is positioned directly below said conveying member; and a wedge attached to said lower support, wherein said wedge is adjacent said working end and wherein said wedge is aligned with said conveying member;

wherein a first direction of travel of said conveying member is substantially similar to a second direction of travel of said ram.

17. The wood processor attachment for skid steer loader of claim 16, including a skid steer loader vehicle, wherein said support structure is rigidly mounted to said skid steer loader vehicle for being adapted to be pivoted by said skid steer loader vehicle.

18. The wood processor attachment for skid steer loader of claim 17, wherein said loading apparatus is attached in a non-movable manner to said support structure.

19. The wood processor attachment for skid steer loader of claim 18, wherein said trough includes at least one cutaway portion.

20. The wood processor attachment for skid steer loader of claim 19, wherein said clamp extends within said at least one cutaway portion.

* * * * *